US008858016B2

(12) United States Patent
Strelchuk

(10) Patent No.: US 8,858,016 B2
(45) Date of Patent: Oct. 14, 2014

(54) LED HEAT SINK APPARATUS

(71) Applicant: Relume Technologies, Inc., Oxford, MI (US)

(72) Inventor: Joseph D. Strelchuk, Lapeer, MI (US)

(73) Assignee: Relume Technologies, Inc., Oxford, MI (US)

( * ) Notice: Subject to any disclaimer, the term of this patent is extended or adjusted under 35 U.S.C. 154(b) by 32 days.

(21) Appl. No.: 13/903,544

(22) Filed: May 28, 2013

(65) Prior Publication Data

US 2014/0160737 A1 Jun. 12, 2014

Related U.S. Application Data

(60) Provisional application No. 61/734,013, filed on Dec. 6, 2012.

(51) Int. Cl.

| | |
|---|---|
| ***F21L 4/02*** | (2006.01) |
| ***F21V 29/00*** | (2006.01) |
| ***F21S 8/06*** | (2006.01) |
| *F21V 31/00* | (2006.01) |
| *F21V 21/08* | (2006.01) |
| *F21V 23/00* | (2006.01) |
| *F21Y 101/02* | (2006.01) |

(52) U.S. Cl.

CPC ..... *F21V 29/2293* (2013.01); *F21S 8/06* (2013.01); *F21V 31/005* (2013.01); *F21V 21/08* (2013.01); *F21V 23/006* (2013.01); *F21Y 2101/02* (2013.01)

USPC ..... 362/184; 362/294; 362/249.02

(58) Field of Classification Search

CPC ..... F21V 29/004; F21V 5/04

USPC ..... 362/184, 249.02, 294, 373

See application file for complete search history.

(56) References Cited

U.S. PATENT DOCUMENTS

| | | | |
|---|---|---|---|
| 3,145,933 | A | 8/1964 | Dickson |
| 3,604,500 | A | 9/1971 | Davis |
| 6,019,493 | A | 2/2000 | Kuo et al. |

(Continued)

FOREIGN PATENT DOCUMENTS

| | | | |
|---|---|---|---|
| CN | 201606775 | U | 10/2010 |
| CN | 202361174 | U | 8/2012 |

(Continued)

*Primary Examiner* — Evan Dzierzynski

(74) *Attorney, Agent, or Firm* — Dickinson Wright PLLC

(57) ABSTRACT

An LED heat sink apparatus (20) comprising a housing (22) that defines a chamber (26). A downward platform (82) is connected with the housing (22) in the chamber (26) to define a bottom cavity (84) and a central cavity (88). LED's (94) are disposed in the bottom cavity (84) for emitting light through a lens (60). The downward platform (82) defines a plurality of holes (106, 108, 116, 118), and a solid ring (104) that has a substantially impervious surface to divide the holes (106, 108, 116, 118) into chimney holes (106, 116, 118) disposed radially inwardly from the solid ring (104) and the LED (94) for directing hot air heated by the LED (94) in the bottom cavity (84) of the chamber (26) into the central cavity (88), and return holes (108) disposed radially outwardly from the solid ring (104) and near the side wall (24) of said housing (22) for directing cool air in the central cavity (88) of the housing (22) that has been cooled by the side wall (24) of the housing (22) into the bottom cavity (84).

18 Claims, 5 Drawing Sheets

(56) References Cited

U.S. PATENT DOCUMENTS

| | | | | |
|---|---|---|---|---|
| 6,254,262 | B1 | 7/2001 | Crunk et al. | |
| 6,616,291 | B1 | 9/2003 | Love | |
| 6,619,830 | B2 | 9/2003 | Nagakura et al. | |
| 6,688,762 | B2 | 2/2004 | Dinant | |
| 7,180,021 | B2 | 2/2007 | Birdwell et al. | |
| 7,217,022 | B2 | 5/2007 | Ruffin | |
| 7,407,309 | B2 | 8/2008 | Scholz | |
| 7,766,512 | B2 | 8/2010 | Chou et al. | |
| 7,806,575 | B2 | 10/2010 | Willwohl et al. | |
| 7,922,365 | B2 | 4/2011 | Liu | |
| 7,959,332 | B2 | 6/2011 | Tickner et al. | |
| 8,007,143 | B2 | 8/2011 | Liu | |
| 8,033,687 | B2 | 10/2011 | Wang | |
| 8,057,071 | B2 | 11/2011 | He et al. | |
| 8,083,374 | B2 | 12/2011 | Mo et al. | |
| 8,104,932 | B2 | 1/2012 | Hamada | |
| 8,109,654 | B2 | 2/2012 | Mo | |
| 8,123,381 | B1 | 2/2012 | Wray | |
| 8,210,707 | B2 | 7/2012 | Wang | |
| 8,215,806 | B2 | 7/2012 | Kwon | |
| 8,240,885 | B2 | 8/2012 | Miller | |
| 8,246,189 | B2 | 8/2012 | Muller et al. | |
| 8,256,926 | B2 | 9/2012 | Louh | |
| 8,282,240 | B2 | 10/2012 | Xiao et al. | |
| 8,297,767 | B2 | 10/2012 | Tseng et al. | |
| 8,680,754 | B2 * | 3/2014 | Premysler | 313/46 |
| 8,684,565 | B2 * | 4/2014 | Lopez et al. | 362/294 |
| 2006/0002104 | A1 | 1/2006 | Willis et al. | |
| 2006/0249550 | A1 | 11/2006 | Giampavolo | |
| 2010/0259919 | A1 | 10/2010 | Khazi et al. | |
| 2010/0264799 | A1 | 10/2010 | Liu et al. | |
| 2011/0080741 | A1 | 4/2011 | Noh | |
| 2011/0085341 | A1 | 4/2011 | Little, Jr. | |
| 2012/0120658 | A1 | 5/2012 | Wilk | |
| 2014/0177224 | A1 * | 6/2014 | Tsai | 362/249.01 |

FOREIGN PATENT DOCUMENTS

| | | | |
|---|---|---|---|
| CN | 202419184 | U | 9/2012 |
| GB | 2486372 | A | 6/2012 |
| JP | 2008034140 | A | 2/2008 |
| JP | 4528277 | B2 | 8/2010 |
| KR | 100940884 | B1 | 2/2010 |
| KR | 20110030753 | A | 3/2011 |

* cited by examiner

LED HEAT SINK APPARATUS

CROSS-REFERENCE TO RELATED APPLICATION

This application claims the benefit of application Ser. No. 61/734,013 filed Dec. 6, 2012.

BACKGROUND OF THE INVENTION

1. Field of the Invention

An LED heat sink apparatus.

2. Description of the Prior Art

LED heat sink apparatuses are known in the art for containing LED's while preventing the LED's from overheating. One such LED heat sink apparatus is disclosed in U.S. Pat. No. 8,123,381 to Donald Lee Wray. The heat sink apparatus includes a housing that is disposed about an axis and defines a chamber. The housing includes a side wall that extends axially between a closed end that closes the chamber and an open end that opens the chamber. A lens is coupled with the closed end of the housing. A downward platform is connected with the side wall in the chamber to define a bottom cavity of the chamber between the downward platform and the lens, and a central cavity of the chamber between the downward platform and the closed end of the housing. A plurality of LED's are coupled with the downward platform in the bottom cavity for emitting light through the lens. The downward platform defines a plurality of holes for passing air that has been heated by the LED's from the bottom cavity to the central cavity.

Additionally, U.S. Pat. No. 8,083,374 to Chen et al. discloses an LED heat sink apparatus which includes a sealing assembly that seals a lens to an open end of a housing to seal a chamber.

However, such LED heat sink apparatuses suffer from certain disadvantages either because they rely on the housing being open to the surrounding atmosphere to cool the housing, which can leave components contained internal to the housing prone to damage due to exposure to external elements, or in the case of sealed assemblies, they rely on complex, inefficient, and/or costly means of cooling the housing. Accordingly, there remains a need for an improvement to efficiently cool LED heat sink apparatuses.

SUMMARY OF THE INVENTION

The invention provides such an LED heat sink apparatus wherein the downward platform defines a solid ring that has a substantially impervious surface disposed radially outwardly from and about at least one LED to divide the holes into at least one chimney hole disposed radially inwardly from the solid ring and the LED for directing hot air heated by the LED and concentrated near the chimney hole in the bottom cavity of the chamber into the central cavity, and at least one return hole disposed radially outwardly from the solid ring and near the side wall of the housing for directing cool air in the central cavity of the housing that has been cooled by the side wall of the housing through the return hole and into the bottom cavity.

Advantages of the Invention

Thus several advantages of one or more aspects of the invention are that the invention provides for an efficient cooling cycle of an LED housing that is sealed to the surrounding atmosphere through an inexpensive and easy to assemble design. Specifically, the solid ring maintains a temperature differential between the air near the chimney hole and return hole to allow air to complete the cooling cycle of rising from the bottom cavity into the central cavity through the chimney hole after having been heated by the LED, and passing back into the bottom cavity through the return hole after having been cooled by the side walls of the housing.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE ENABLING EMBODIMENTS

Figure 1:
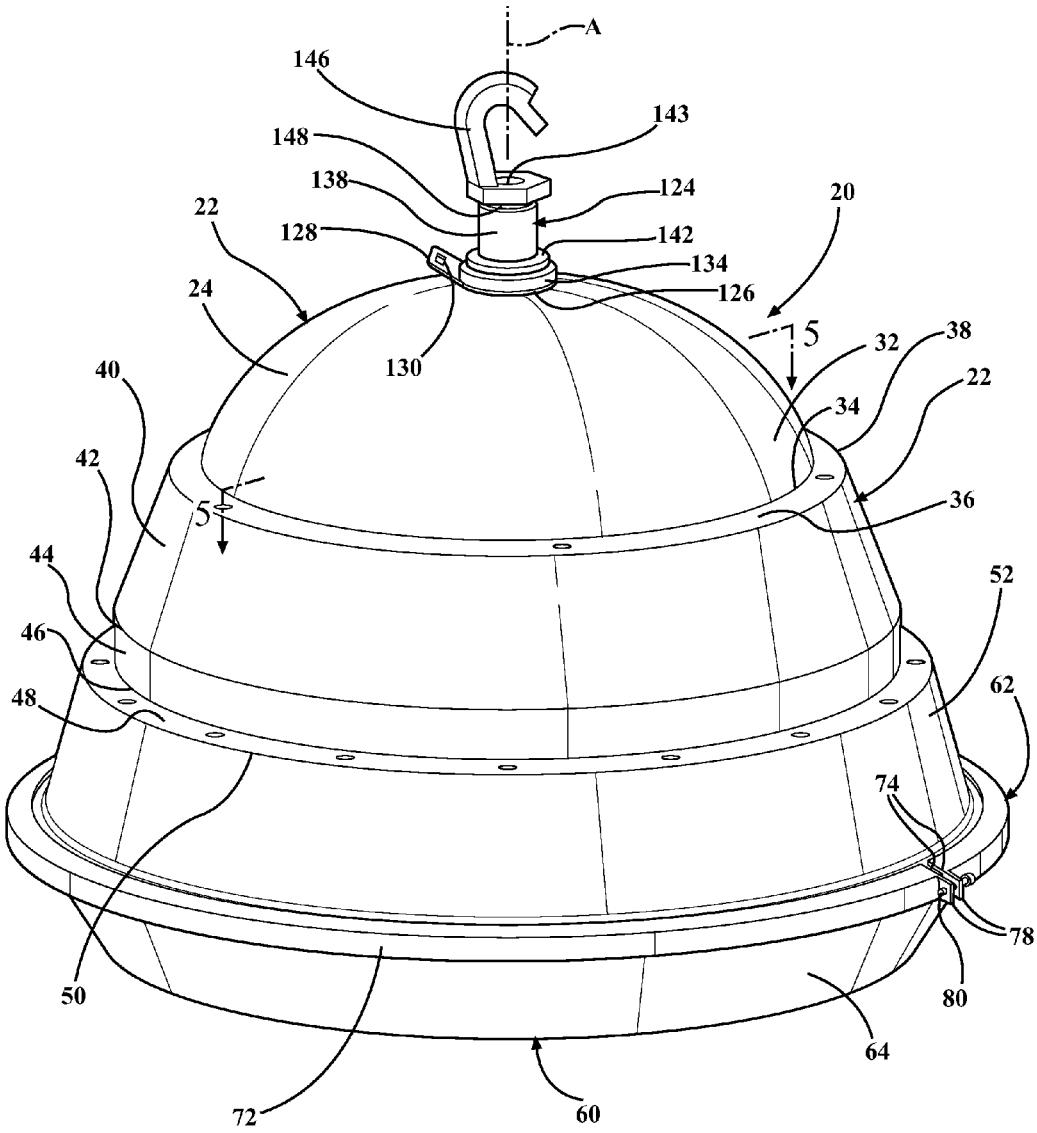
FIG. 1 is perspective view of the first embodiment of the LED heat sink apparatus.
Figure 2:
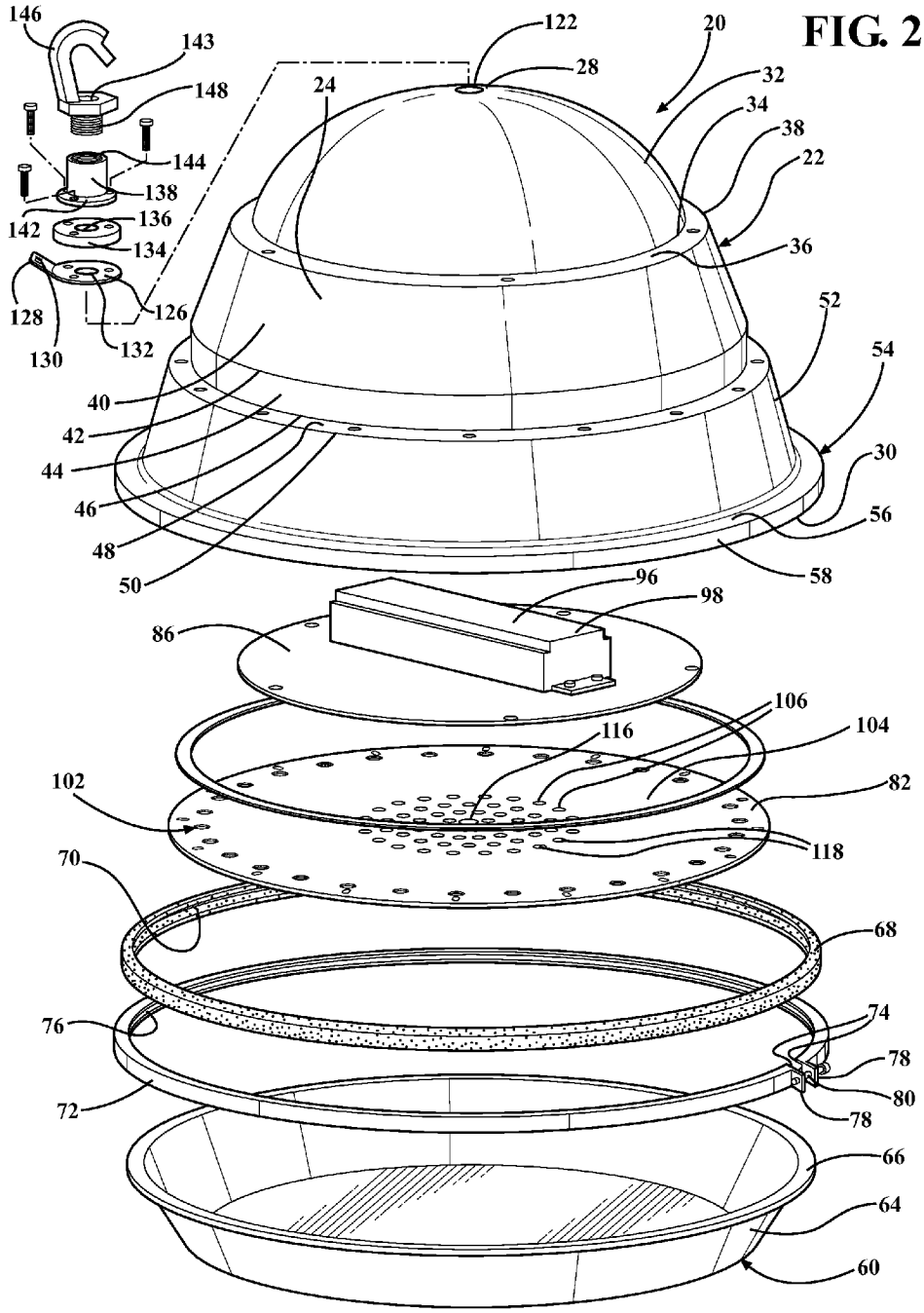
FIG. 2 is an exploded perspective view of the first embodiment of the LED heat sink apparatus.

Referring to the Figures, wherein like numerals indicate corresponding parts throughout the several views, an LED heat sink apparatus 20 is generally shown for hanging from a mount.

The heat sink apparatus 20 includes a housing 22, generally indicated, that has a generally bell shape with a side wall 24 that extends about and along an axis A and presents an outer surface to define a chamber 26. The housing 22 extends between a closed end 28 that closes the chamber 26 and an open end 30 that opens the chamber 26. In the enabling embodiments, the housing 22 is made of a lightweight aluminum material, but is should be appreciated that other materials could be used, e.g. metal or plastic.

The side wall 24 of the housing 22 defines a top segment 32 that has a hemispherical shape and extends generally axially from the closed end 28 of the housing 22 to an edge 34 of the top segment 32. An upper step 36 extends annularly about and radially outwardly from the edge 34 of the top segment 32 to an upper periphery 38. A first frustoconical section 40 extends generally axially from the upper periphery 38 of the upper step 36 in a frustoconical shape to a crest 42 that extends annularly about the axis A. A cylindrical section 44 extends axially from the crest 42 to a base margin 46. A lower step 48 extends annularly about and radially outwardly from the base margin 46 to a lower periphery 50 of the lower step 48. A second frustoconical section 52 extends generally axially from the lower periphery 50 of the lower step 48 in a frustoconical shape to the open end 30 of the housing 22. It should be appreciated that the side wall 24 of the housing 22 could have other shapes, however, it should extend radially outwardly between the closed end 28 to the open end 30 to provide for increased surface area of the side wall 24 that is exposed to the atmosphere.

An L-shaped flange 54, generally indicated, extends annularly about the axis A at the open end 30 of the housing 22. The flange 54 extends radially outwardly in a horizontal leg 56 and extends axially in a vertical leg 58 to define a cylindrical shape.

A lens 60, generally indicated, made of a translucent organic polymeric material is supported by the flange 54 of the housing 22 and is sealed to the flange 54 by a seal assembly 62, generally indicated. The lens 60 has a frustoconical-shaped body 64 and a lip 66 that extends radially from the body 64 toward the vertical leg 58 at the open end 30 of the housing 22. It should be appreciated that the lens 60 could be made of other materials, but should be translucent to allow light to pass therethrough. Further, the body 64 of the lens 60 could have other shapes like, but not limited to a hemispherical shape.

As best presented in FIGS. 2 and 4-6, the seal assembly 62 includes an O-ring 68 that has a C-shaped cross section that defines a canal 70 which receives the lip 66 of the lens 60. The seal assembly 62 further includes a clamp 72 that extends circumferentially about the flange 54 of the housing 22 between a pair of clamp ends 74. The clamp 72 generally has a C-shaped cross section that defines a pocket 76 which receives the horizontal leg 56 of the flange 54 of the housing 22 and the O-ring 68 to sandwich the horizontal leg 56 of the flange 54 and the O-ring 68 between the clamp 72 and the lens 60 to close the horizontal leg 56 of the flange 54 to the lens 60. A plate 78 extends radially outwardly from the clamp 72 near each of the clamp ends 74 to define a pair of radially spaced plates 78. A tightening fastener 80 extends through the plates 78 of the clamp 72 for moving the clamp ends 74 of the clamp 72 toward or away from one another to tighten the clamp 72 about the flange 54 of the housing 22 and the O-ring 68 to tighten or loosen the seal assembly 62. In the enabling embodiments, the fastener 80 is a threaded bolt, however, it should be appreciated that other fasteners could be used to tighten the clamp 72 about the flange 54 and O-ring 68 such as, but not limited to a latch mechanism or adhesive.

A disc shaped downward platform 82 engages and is disposed in the chamber 26 and is connected with the lower step 48 to define a bottom cavity 84 of the chamber 26 between the downward platform 82 and the lens 60. As best presented in FIG. 3, the downward platform 82 has a downward platform radius R between its center and perimeter. Additionally, a disc shaped upward platform 86 engages and is connected with the upper step 36 to define a central cavity 88 of the chamber 26 between the upward platform 86 and the downward platform 82, and an uppermost cavity 90 of the chamber 26 between the upward platform 86 and the closed end 28 of the housing 22. It should be appreciated that the downward and upward platforms 82, 86 could have other shapes, however it should match the cross sectional shape of the housing 22. Further, in the enabling embodiments, the downward and upward platforms 82, 86 are connected to the lower and upper steps 48, 36 by a plurality of bolts, but it should be appreciated that they could be connected in other ways such as, but not limited to an adhesive or screws.

Figure 3:
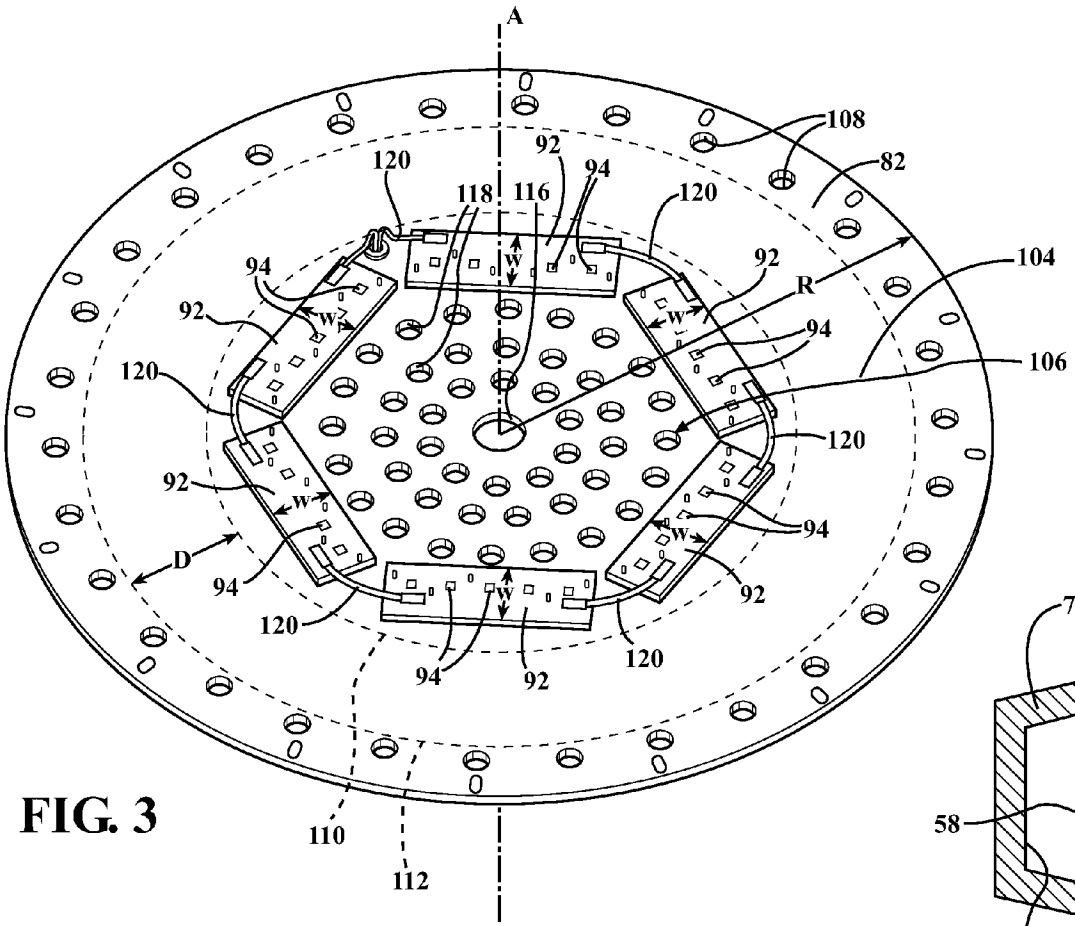
FIG. 3 is a perspective view of the lower platform of the LED heat sink apparatus.

As best presented in FIG. 3, a plurality of metal core boards 92 engage and are connected with the downward platform 82 in the bottom cavity 84. A plurality of LED's 94 engage the core boards 92 in the bottom cavity 84 for emitting light through the lens 60. It should be appreciated that any number of core boards 92 and LED's 94 could be positioned on the downward platform 82 to adapt the housing 22 to emit a desired intensity of light through the lens 60. In the enabling embodiment, the LED's 94 are disposed in a pattern extending annularly about the axis A, however, it should be appreciated that the LED's 94 could be disposed in various other configurations.

The apparatus further includes a power source 96, 196 for energizing the LED's, and a driver 98, 198 disposed on and connected with the upward platform 86 in the uppermost cavity 90 for regulating the electricity from the power source 96, 196 to the LED's 94. In a first enabling embodiment best presented in FIGS. 1, 2 and 5, the power source 96 is generally integral with the driver 98 in the same assembly, such that the power source 96 and driver 98 are completely disposed within the chamber 26 of the housing 22. In a second enabling embodiment best presented in FIG. 6, the power source 196 is external to the housing 22. A plurality of wires 100 extend from the power source 96, 196 to the driver 98, 198 and through the upward and downward platforms 86, 82 to the LED's 94 to electrically connect the power source 96, 196, driver 98, 198 and LED's 94.

As best presented in FIG. 3, the downward platform 82 defines a plurality of holes 106, 108, 116, 118 for allowing air to flow between the bottom cavity 84 and the central cavity 88 of the chamber 26. The downward platform 82 further defines a solid ring 104 that has a substantially impervious surface disposed radially outwardly from and annularly about the LED's 94 to divide the holes 106, 108, 116, 118 into a plurality of chimney holes 106, 116, 118 disposed radially inwardly from the solid ring 104 and the LED's 94 and a plurality of return holes 108 disposed radially outwardly from the LED's 94 and near the side wall 24 of the housing 22. As best presented by the plurality of parallel arrows in FIGS. 5 and 6, the chimney holes 106, 116, 118 are for directing hot air heated by the LED's 94 during operation and concentrated near the chimney holes 106, 116, 118 in the bottom cavity 84 of the chamber 26 into the central cavity 88. Further, the return holes 108 are for directing air in the central cavity 88 that has been cooled by the side walls 24 through the return holes 108 and into the bottom cavity 84. Accordingly, the heat sink apparatus 20 of the present invention advantageously provides for an efficient cooling cycle for such a sealed system wherein air is heated by the LED's 94 in the bottom cavity 84 of the chamber 26, flows upwardly through the chimney holes 106, 116, 118, flows upwardly toward the closed end 28 of the housing 22 and radially outwardly in a generally mushroom shape toward the side wall 24. The air is cooled by the side wall 24 because the side wall 24 remains cooled by the atmosphere and flows downwardly toward the open end 30 of the housing 22, and back into the bottom cavity 84. It should be appreciated that the solid ring 104 being "substantially impervious" means that air is largely unable to flow through the solid ring 104, and the presence of openings that allow a very small amount of air to pass between the lower and central cavities 88 relative to the chimney and return holes 106, 108 are not considered to render the solid ring 104 pervious. Additionally, it should be appreciated that the bell shape of the housing 22 advantageously provides a large surface area of the side wall 24 to provide for increased cooling of the air adjacent to the side wall 24 as it that passes downwardly toward the return holes 108.

As best presented in FIG. 3, in the enabling embodiments, the solid ring 104 extends radially between a circular inside boundary 110 and a circular outside boundary 112 over a radial distance D for preventing air flow through the solid ring 104 of the downward platform 82 for maintaining a temperature differential in the air near the downward platform 82 at the chimney holes 106, 116, 118 and at the return holes 108 to advantageously allow air to complete the aforementioned cooling cycle. It should be appreciated that the inside and outside boundaries 110, 112 could depart from being a circular shape such as, but not limited to being an elliptical shape.

Figure 6:
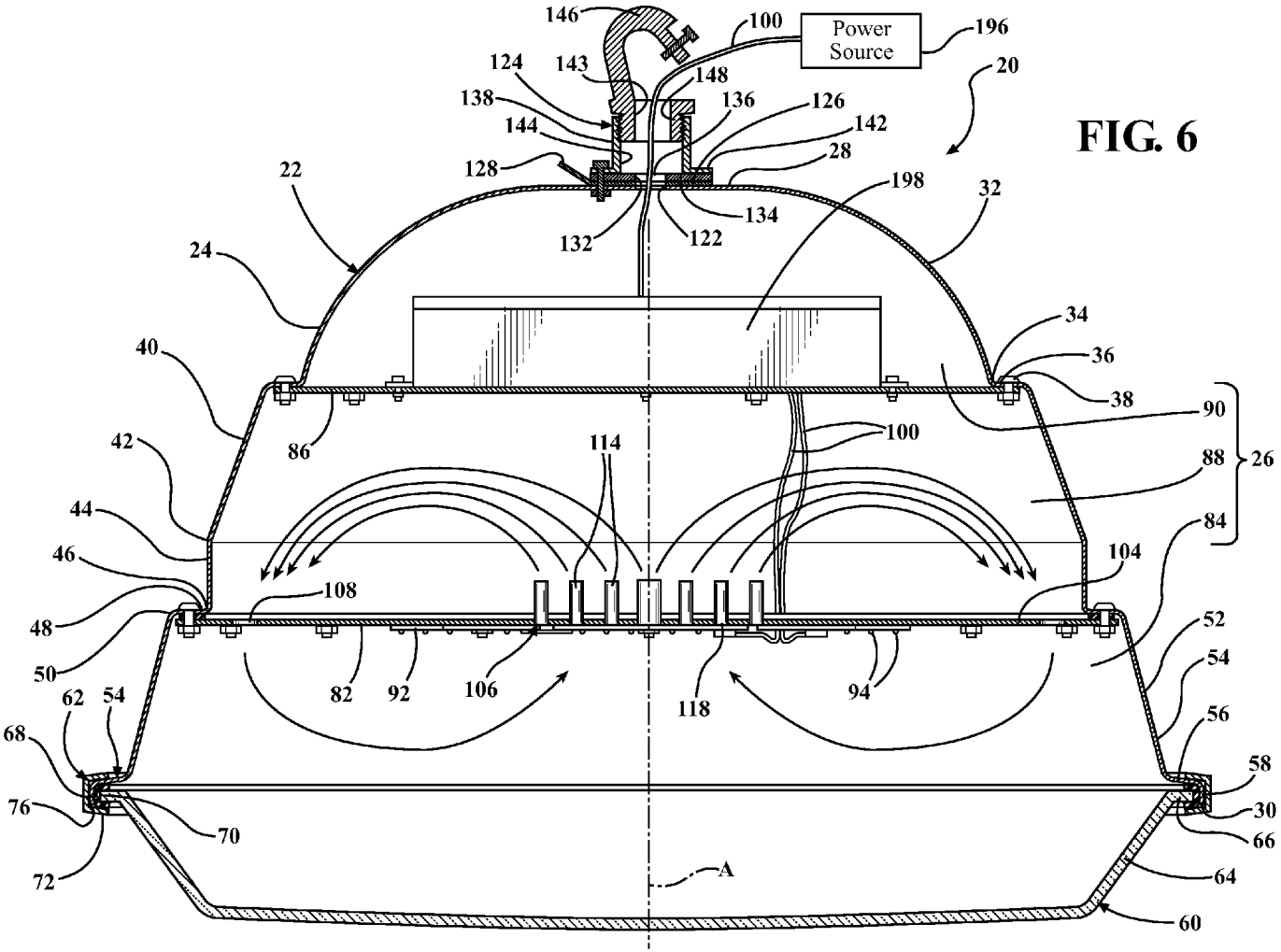
FIG. 6 is a cutaway view of the second enabling embodiment of the LED heat sink apparatus.

In the second enabling embodiment as best presented in FIG. 6, a tube shaped flow enhancer 114 extends away from the downward platform 82 in the central cavity 88 about each chimney hole 106, 116, 118 to straighten the flow of air into the central cavity 88 of the chamber 26 from the bottom cavity 84 of the chamber 26 to produce a venture-like flow of the air passing into the central cavity 88. It should be appreciated that flow enhancers 114 could be disposed about any number of respective chimney holes 106, 116, 118, could be disposed about multiple chimney holes 106, 116, 118, and could be various axial lengths. Additionally, it should be appreciated that the flow enhancers 114 could be present regardless of whether the power source is disposed inside the chamber 26 as presented in the first enabling embodiment or outside of the chamber 26 as presented in the second enabling embodiment.

The chimney holes 106, 116, 118 each define a chimney hole diameter between peripheral edges of the chimney holes 106, 116, 118. In the enabling embodiments, the radial distance D of the solid ring 104 is greater than the twice the chimney hole diameter to radially space the return holes 108 from the chimney holes 106, 116, 118 and the core boards 92 to ensure that the chimney holes 106, 116, 118 and return holes 108 are sufficiently spaced from one another to maintain a necessary temperature differential in the air near the downward platform 82 at the chimney holes 106, 116, 118 and return holes 108 to provide for the cooling cycle. Further, in the enabling embodiment, the radial distance D of the solid ring 104 is at least one third of the length of the downward platform radius R, however, it should be appreciated that the radial distance D could vary to accommodate for different sizes and configurations of the heat sink apparatus 20.

In the enabling embodiments, the chimney holes 106, 116, 118 include a center hole 116 that is coaxially aligned with the axis A, and an array of adjacent holes 118 disposed about the center hole 116 in an annular band. The annular band of adjacent holes 118 includes three rows of adjacent holes 118, that each extend circularly about the axis A to space the adjacent rows radially from one another. It should be appreciated that more or fewer bands of adjacent holes 118 could be defined by the downward platform 82, and the chimney holes 106 could be arranged in various other patterns. Further, in the enabling embodiment, the center hole 116 has a diameter of one inch and the adjacent holes 118 have a diameter of one half of an inch, however, it should be appreciated that the diameters of the holes 102 could be other sizes to accommodate different sizes and configurations of the heat sink apparatus 20. Additionally, in the enabling embodiments, the chimney holes 106 have a circular shape, but it should be appreciated that they could have other shapes such as, but not limited to an elliptical shape.

The return holes 108 are spaced circumferentially from one another about the downward platform 82 and are spaced radially from the chimney holes 106 and from the core boards 92. In the enabling embodiment, the return holes 108 are spaced equally circumferentially from one another, but it should be appreciated that they could be spaced by other lengths, and any number of return holes 108 could be defined by the downward platform 82. Further, in the enabling embodiment, the return holes 108 have a diameter of one half an inch, however, the return holes 108 could have other diameters to provide for an ideal cooling cycle that corresponds with the shape of the housing 22. Additionally, like the chimney holes 106, the return holes 108 have a circular shape in the enabling embodiment, but it should be appreciated that the return holes 108 could have other shapes like, but not limited to an elliptical shape.

In the enabling embodiments, there are six rectangular shaped core boards 92 that are disposed about the chimney holes 106 in a hexagonal configuration, with each of the core boards 92 defining one linear boundary of the hexagon. Each of the core boards 92 defines a width W extending across the core board 92, and in the enabling embodiments, the radial distance D of the solid ring 104 is greater than the width W of each of the core boards 92 to advantageously provide for sufficient spacing between the chimney and return holes 106, 108 to maintain a sufficient temperature differential between the air near the downward platform 82 at the return holes 108 and the chimney holes 106. It should be appreciated that the radial distance D could vary depending on the size and configuration of the heat sink apparatus 20, and further it should be appreciated that the core boards 92 could be disposed about the chimney holes 106 in other configurations. A plurality of connect cables 120 extend between each of the core boards 92 for electrically connecting the LED's 94 disposed on the core boards 92.

The top segment 32 of the housing 22 defines a first cable orifice 122 that extends therethrough into the chamber 26. In the enabling embodiments, the first cable orifice 122 is in alignment with the axis A at the closed end 28 of the housing 22, but it should be appreciated that it could be defined at other areas of the top segment 32 of the housing 22.

A hanger assembly 124, generally indicated, is coupled with the outer surface of the top segment 32 of the housing 22 at the closed end 28 for hanging the housing 22. The hanger assembly 124 includes a generally ring shaped spacer 126 that engages and is connected with the outer surface of the top segment 32 of the housing 22 at the closed end 28 in coaxial alignment with the first cable orifice 122. It should be appreciated that the spacer 126 could have other shapes such as, but not limited to an elliptical shape. The spacer 126 includes an extension 128 that extends at an angle away from the axis A. The extension 128 defines a slot 130 that extends therethrough for receiving a tether cable for hanging the housing 22. The spacer 126 further defines a second cable orifice 132 that extends therethrough in coaxial alignment with the first cable orifice 122.

The hanger assembly 124 further includes a ring shaped washer 134 that engages and is connected with the spacer 126 in coaxial alignment with the spacer 126. The washer 134 defines a third cable orifice 136 in coaxial alignment with the second cable orifice 132. It should be appreciated that the washer 134 could have other shapes such as, but not limited to an elliptical shape.

The hanger assembly 124 also includes a receiver 138 that includes a tube portion that has a tubular shape and a brim portion 142 that extends radially away from the tube portion in coaxial alignment with and connected with the washer 134. The tube portion of the receiver 138 defines a threaded bore 144 that extends therethrough in coaxial alignment with the third cable orifice 136.

The hanger assembly 124 also includes a hanging hook 146 for hanging the housing 22 from the mount. The hanging hook 146 defines a threaded tubular shaped barrel 148 being for threadedly engaging the bore 144, and a generally J-shaped catch for coupling with the mount. A screw extends through and threadedly engages the catch of the hanging hook 146 for securing the catch to the mount. The barrel 148 of the hanging hook 146 defines an opening 143 that extends therethrough in coaxial alignment with the bore 144. It should be appreciated that different sized and shaped hanging hooks 146 could be threadedly disposed in the bore 144 of the receiver 138.

Figure 4:
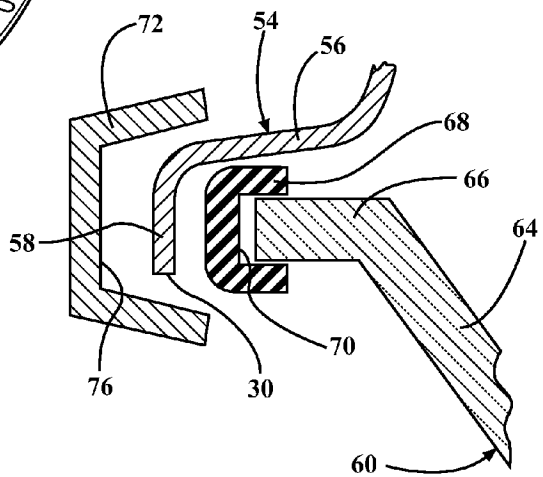
FIG. 4 is a an exploded sectional view of the seal assembly of the LED heat sink apparatus.

In the first enabling embodiment wherein the power source 96 is disposed in the chamber 26, as best shown in FIG. 4, the hanger assembly 124 further includes a cap closer 152 that seals the first, second and third cable orifices 122, 132, 136 to seal the chamber 26 from the atmosphere. It should be appreciated that the bore 144 of the receiver 138, opening of the hanging hook 146, or any of the first cable orifice 122, second cable orifice 132, or third cable orifice 136 could be sealed individually or in combination with one another.

Figure 5:
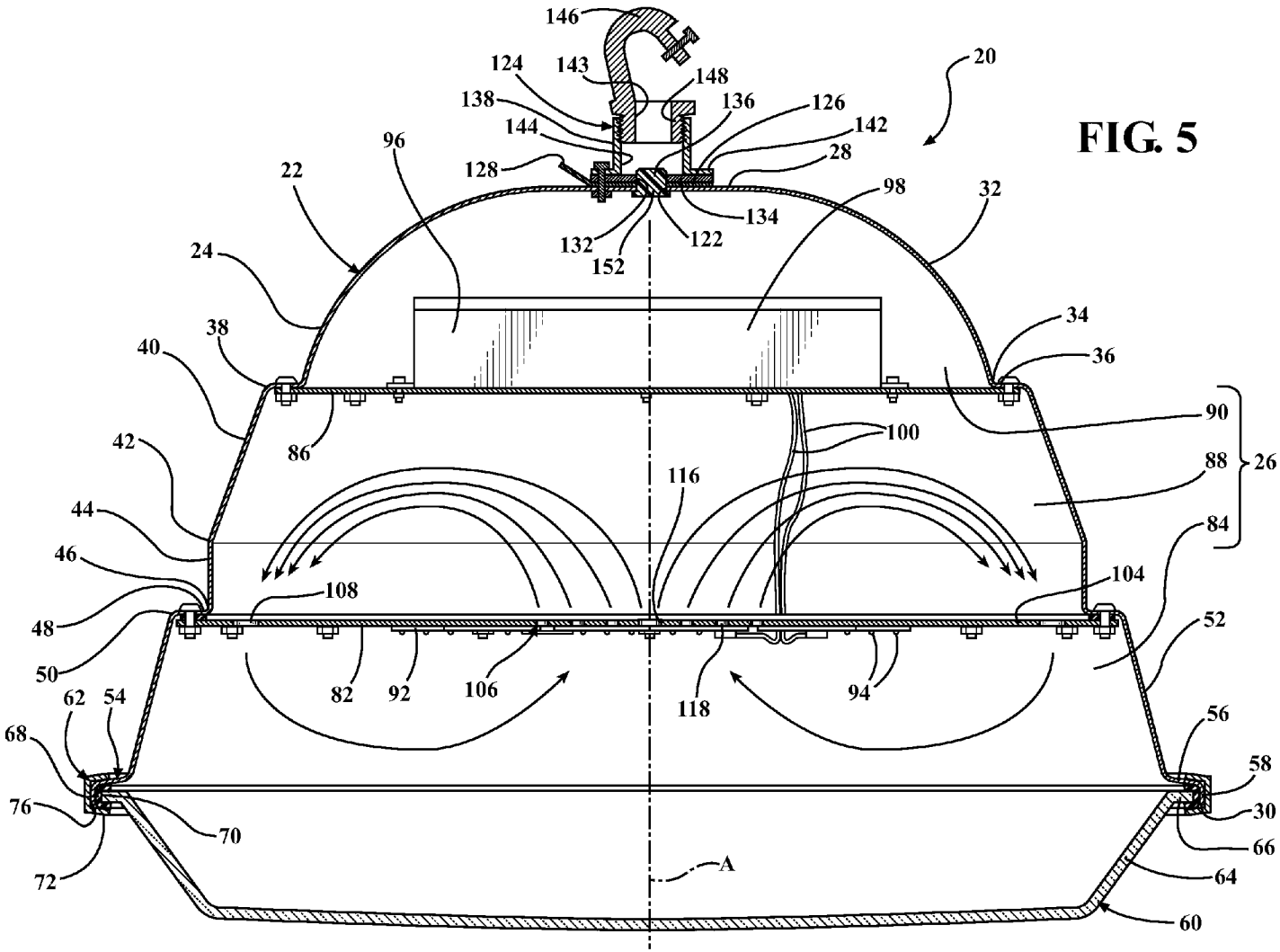
FIG. 5 is a cutaway view of the first enabling embodiment of the LED heat sink apparatus taken at 5-5 of FIG. 1.

In the second enabling embodiment wherein the power source 196 is external to the housing 22, as best shown in FIG. 5, the wires 100 further extend from the power source 196 and through the opening 143 of the hanging hook 146, and the first, second, and third cable orifices 122, 132, 136 to the driver 198. The first, second, and third cable orifices 122, 132, 136 are sealed about the wires 100 to seal the chamber 26 from the atmosphere. It should be appreciated that the bore 144 of the receiver 138, opening of the hanging hook 146, or the first, second, and third cable orifices 122, 132, 136 or any combination thereof, are sealed about the wires 100 to seal the chamber 26 from the atmosphere.

Obviously, many modifications and variations of the present invention are possible in light of the above teachings and may be practiced otherwise than as specifically described while within the scope of the appended claims. That which is prior art in the claims precedes the novelty set forth in the "characterized by" clause. The novelty is meant to be particularly and distinctly recited in the "characterized by" clause whereas the antecedent recitations merely set forth the old and well-known combination in which the invention resides. These antecedent recitations should be interpreted to cover any combination in which the inventive novelty exercises its utility. The use of the word "said" in the apparatus claims refers to an antecedent that is a positive recitation meant to be included in the coverage of the claims whereas the word "the" precedes a word not meant to be included in the coverage of the claims. In addition, the reference numerals in the claims are merely for convenience and are not to be read in any way as limiting.

What is claimed is:

1. An LED heat sink apparatus (20) comprising;

a housing (22) with a side wall (24) disposed about an axis (A) to define a chamber (26) and extending between a closed end (28) closing said chamber (26) and an open end (30) opening said chamber (26), a lens (60) coupled with said closed end (28) of said housing (22), a downward platform (82) connected with said side wall (24) of said housing (22) in said chamber (26) to define a bottom cavity (84) of said chamber (26) between said downward platform (82) and said lens (60) and a central cavity (88) of said chamber (26) between said downward platform (82) and said closed end (28) of said housing (22), at least one LED (94) coupled with said downward platform (82) in said bottom cavity (84) for emitting light through said lens (60), said downward platform (82) defining a plurality of holes (106, 108, 116, 118) for passing air between said bottom cavity (84) and said central cavity (88), a seal assembly (62) sealing said lens (60) to said open end (30) of said housing (22) to seal said chamber (26), and characterized by, said downward platform (82) further defining a solid ring (104) having a substantially impervious surface disposed radially outwardly from and about said LED to divide said holes (106, 108, 116, 118) into at least one chimney hole (106, 116, 118) disposed radially inwardly from said solid ring (104) and said LED (94) for directing hot air heated by said LED and concentrated near said chimney hole (106, 116, 118) in said bottom cavity (84) of said chamber (26) into said central cavity (88) and at least one return hole (108) disposed radially outwardly from said solid ring (104) and near said side wall (24) of said housing (22) for directing cool air in said central cavity (88) of said housing (22) that has been cooled by said side wall (24) of said housing (22) through said return hole (108) and into said bottom cavity (84).

2. An apparatus as set forth in claim 1 wherein said solid ring (104) extends radially between an inside boundary (110) being circular and an outside boundary (112) being circular over a radial distance (D) for preventing air flow through said solid ring (104) of said downward platform (82) for maintaining a temperature differential in the air near said downward platform (82) at said chimney hole (106, 116, 118) and at said return hole (108).

3. An apparatus as set forth in claim 2 wherein said chimney hole (106, 116, 118) defines a chimney hole diameter and said radial distance (D) of said solid ring (104) is at least twice the length of said chimney hole diameter to radially space said return hole (108) from said chimney hole (106, 116, 118).

4. An apparatus as set forth in claim 2 wherein said chimney hole (106, 116, 118) is one of a plurality of chimney holes (106, 116, 118) and said chimney holes (106, 116, 118) include a center hole (116) that is coaxially aligned with said axis (A) and an array of adjacent holes (118) disposed about said center hole (116) in an annular band.

5. An apparatus as set forth in claim 4 wherein said annular band of said adjacent holes (118) includes three rows of said adjacent holes (118) each extending circularly about said axis (A) to space said adjacent rows radially from one another.

6. An apparatus as set forth in claim 2 wherein said return hole (108) is one of a plurality of return holes (108) and said return holes (108) are spaced equally circumferentially from one another about said downward platform (82) and spaced radially from said chimney holes (106, 116, 118) to define said outside boundary (112) of said solid ring (104).

7. An apparatus as set forth in claim 2 wherein said downward platform (82) has a downward platform radius (R) and said radial distance (D) of said solid ring (104) is at least one third of the length of said downward platform radius (R).

8. An apparatus as set forth in claim 2 wherein said LED (94) is one of a plurality of LED's (94) and said LED's (94) are disposed in a pattern extending annularly about said axis (A), six core boards (92) that each have a rectangular shape engage and are connected with said downward platform (82) in said bottom cavity (84) and are disposed about said chimney holes (106) in a hexagonal configuration with each of said core boards (92) defining one linear boundary of the hexagon and said inside boundary (110) of said solid ring (104) is defined about said core boards (92), and at least one of said LED's (94) is disposed on each of said core boards (92).

9. An apparatus as set forth in claim 8 wherein each of said core boards (92) defines a width (W) extending across said core board (92), and said radial distance (D) of said solid ring (104) is greater than said width (W) of each of said core boards (92).

10. An apparatus as set forth in claim 1 wherein said housing (22) defines a flange (54) that has an L-shape that extends radially outwardly in a horizontal leg (56) from and annularly about said open end (30) and axially in a vertical leg (58) that defines a cylindrical shape at said open end (30).

11. An apparatus as set forth in claim 10 wherein said lens (60) has a body (64) and a lip (66) that extends radially outwardly from said body (64) toward said vertical leg (58) at said open end (30), and said seal assembly (62) includes an O-ring (68) that has a generally ring shape and a C shaped cross section and defines a pocket (76) receiving said lip (66) of said lens (60).

12. An apparatus as set forth in claim 11 wherein said seal assembly (62) further includes a clamp (72) that extends circumferentially about said flange (54) of said housing (22) between a pair of clamp ends (74), and said clamp (72) generally has a C shaped cross-section and defines a pocket (76) that receives said horizontal leg (56) of said flange (54) of said housing (22) and said O-ring (68) to sandwich said horizontal leg (56) of said flange (54) and said O-ring (68) between said clamp (72) and said lens (60) to close said horizontal leg (56) of said flange (54) to said lens (60).

13. An apparatus as set forth in claim 12 wherein said clamp (72) further includes a plate (78) that extends radially outwardly from said clamp (72) near each of said clamp ends (74) of said clamp (72) to define a pair of plates (78), and a tightening fastener (80) extends through said plates (78) of said clamp (72) for moving said clamp ends (74) of said clamp (72) toward or away from one another to tighten said clamp (72) about said flange (54) of said housing (22) and said O-ring (68) to tighten or loosen said seal assembly (62).

14. The apparatus as set forth in claim 1 and further comprising a flow enhancer (114) having a tubular shape extending away from said downward platform (82) in said central cavity (88) about said chimney hole (106, 116, 118) to straighten the flow of air into said central cavity (88) of said chamber (26) from said bottom cavity (84) of said chamber (26).

15. An LED heat sink apparatus (20) for hanging from a mount comprising;

a housing (22) having a generally bell-shape with a side wall (24) disposed about an axis (A) to define a chamber (26) and extending between a closed end (28) closing said chamber (26) and an open end (30) opening said chamber (26), said housing (22) being made of an aluminum material and defining an outer surface, said side wall (24) of said housing (22) defining a top segment (32) having a hemispherical shape extending generally axially from said closed end (28) to an edge (34) of said top segment (32), said side wall (24) of said housing (22) defining an upper step (36) extending annularly about and radially outwardly from said edge (34) to an upper periphery (38) of said upper step (36), said side wall (24) of said housing (22) defining a first frustoconical section (40) extending from said upper periphery (38) of said upper step (36) generally axially in a frustoconical shape to a crest (42) extending annularly about said axis (A), said side wall (24) of said housing (22) defining cylindrical section (44) having a cylindrical shape extending axially from said crest (42) to a base margin (46), said side wall (24) of said housing (22) defining a lower step (48) extending annularly about and radially outwardly from said base margin (46) to a lower periphery (50) of said lower step (48), said side wall (24) of said housing (22) defining a second frustoconical section (52) extending from said lower periphery (50) of said lower step (48) generally axially in a frustoconical shape to said open end (30), said side wall (24) of said housing (22) defining a flange (54) having an L-shape extending radially outwardly in a horizontal leg (56) from and annularly about said open end (30) of said housing (22) and axially in a vertical leg (58) defining a cylindrical shape, a lens (60) of a translucent organic polymeric material supported by said flange (54), said lens (60) having a body (64) having a frustoconical shape and a lip (66) extending radially from said body (64) toward said vertical leg (58) at said open end (30), a seal assembly (62) sealing said lens (60) to said flange (54) at said open end (30) of said housing (22), a downward platform (82) having a disc shape engaging and connected with said lower step (48) to define a bottom cavity (84) of said chamber (26) between said downward platform (82) and said lens (60), said downward platform (82) having a downward platform radius (R), a core board (92) made of a metal material engaging and connected with said downward platform (82) in said bottom cavity (84), an LED (94) in engagement with said core board (92) in said bottom cavity (84) for emitting light through said lens (60), an upward platform (86) having a disc shape engaging and connected with said upper step (36) to define a central cavity (88) of said chamber (26) between said upward platform (86) and said downward platform (82) and an uppermost cavity (90) of said chamber (26) between said upward platform (86) and said closed end (28) of said housing (22), said downward platform (82) defining a plurality of holes (106, 108, 116, 118) for allowing air to flow between said bottom cavity (84) and said central cavity (88) of said chamber (26), a power source (96, 196) for energizing said LED (94), a driver (98, 198) disposed on and connected with said upward platform (86) in said uppermost cavity (90) for regulating the electricity to said LED (94), a plurality of wires (100) extending from said power source (96, 196) to said driver (98, 198) and through said upward platform (86) and said downward platform (82) to said LED (94) to electrically connect said power source (96, 196) and said driver (98, 198) and said LED (94), said top segment (32) of said housing (22) defining a first cable orifice (122) aligned with said axis (A) extending therethrough into said chamber (26) at said closed end (28), a hanger assembly (124) coupled with said outer surface of said top segment (32) of said housing (22) at said closed end (28) for hanging said housing (22), said hanger assembly (124) including a spacer (126) having a generally ring-shape engaging and connected with said outer surface of said top segment (32) of said housing (22) at said closed end (28) and in coaxial alignment with said first cable orifice (122), said spacer (126) including an extension (128) extending at an angle away from said axis (A), said extension (128) defining a slot (130) extending therethrough for receiving a tether cable for hanging said housing (22), said spacer (126) defining a second cable orifice (132) extending therethrough in coaxial alignment with said first cable orifice (122), said hanger assembly (124) further including a washer (134) having a ring-shape engaging and connected with and in coaxial alignment with said spacer (126), said washer (134) defining a third cable orifice (136) in coaxial alignment with said second cable orifice (132), said hanger assembly (124) including a receiver (138) including a tube portion having a tubular shape and a brim portion (142) extending radially away from said tube portion and in coaxial alignment and engaging and connected with said washer (134), said tube portion of said receiver (138) defining a bore (144) extending therethrough in coaxial alignment with said third cable orifice (136), said bore (144) being threaded, said hanger assembly (124) including a hanging hook (146) defining a barrel (148) having a tubular shape being threaded for threadedly engaging said bore (144) and a catch having a generally J-shape for hanging said housing (22) from the mount, a screw extending through and threadedly engaging said catch of said hanging hook (146) for securing said catch to the mount, said barrel (148) of said hanging hook (146) defining an opening (143) extending therethrough in coaxial alignment with said bore (144), said LED (94) being one of a plurality of LED's (94) engaging said core board (92), said LED's (94) disposed in a pattern extending annularly about said axis (A)

and characterized by, said downward platform (82) further defining a solid ring (104) having a substantially impervious surface disposed radially outwardly from and annularly about said LED's (94) to divide said holes (106, 108, 116, 118) into a plurality of chimney holes (106, 116, 118) disposed radially inwardly from said solid ring (104) and said LED's (94) for directing hot air heated by said LED's (94) and concentrated near said chimney holes (106, 116, 118) in said bottom cavity (84) of said chamber (26) into said central cavity (88) and a plurality of return holes (108) disposed radially outwardly from said LED's (94) and near said side wall (24) of said housing (22) for directing cool air in said central cavity (88) of said housing (22) that has been cooled by said side walls (24) of said housing (22) through said return holes (108) and into said bottom cavity (84), said solid ring (104) extending radially between an inside boundary (110) being circular and an outside boundary (112) being circular over a radial distance (D) for preventing air flow through said solid ring (104) of said downward platform (82) for maintaining a temperature differential in the air near said downward platform (82) at said chimney holes (106, 116, 118) and at said return holes (108), said chimney holes (106, 116, 118) each defining a chimney hole diameter, said radial distance (D) being greater than the twice said chimney hole diameter to radially space said return holes (108) from said chimney holes (106, 116, 118) and said core boards (92), said chimney holes (106, 116, 118) including a center hole (116) being coaxially aligned with said axis (A) and an array of adjacent holes (118) disposed about said center hole (116) in an annular band, said annular band of adjacent holes (118) including three rows of said adjacent holes (118) each extending circularly about said axis (A) to space said adjacent rows radially from one another, said center hole (116) having a diameter of one inch, said return holes (108) spaced equally circumferentially from one another about said downward platform (82) and spaced radially from said chimney holes (106, 116, 118) and from said core board (92), said adjacent holes (118) and said return holes (108) each having a diameter one half of an inch, said radial distance (D) of said solid ring (104) being at least one third of the length of said downward platform radius (R), said core board (92) being one of six core boards (92) each having a rectangular shape and disposed about said chimney holes (106, 116, 118) in a hexagonal configuration with each of said core boards (92) defining one linear boundary of the hexagon, each of said core boards (92) defining a width (W) extending across said core board (92), said radial distance (D) of said solid ring (104) being greater than said width (W) of each of said core boards (92), a plurality of connect cables (120) extending between each of said core boards (92) for electrically connecting said LED's (94) on said core boards (92), said seal assembly (62) including an O-ring (68) having a generally ring shape and a C shaped cross section defining a canal (70) receiving said lip (66) of said lens (60), said seal assembly (62) further including a clamp (72) extending circumferentially about said flange (54) of said housing (22) between a pair of clamp ends (74), said clamp (72) generally having a C shaped cross-section defining a pocket (76) receiving said horizontal leg (56) of said flange (54) of said housing (22) and said O-ring (68) to sandwich said horizontal leg (56) of said flange (54) and said O-ring (68) between said clamp (72) and said lens (60) to close said horizontal leg (56) of said flange (54) to said lens (60), said clamp (72) further including a plate (78) extending radially outwardly from said clamp (72) near each of said clamp ends (74) of said clamp (72) to define a pair of plates (78), said seal assembly (62) further including a tightening fastener (80) extending through said plates (78) of said clamp (72) for moving said clamp ends (74) of said clamp (72) toward or away from one another to tighten said clamp (72) about said flange (54) of said housing (22) and said O-ring (68) to tighten or loosen said seal assembly (62).

16. The apparatus as set forth in claim 15 wherein the hanger assembly (124) further includes a cap closer (152) for sealing at least one of said first cable orifice (122) and said second cable orifice (132) and said third cable orifice (136) for sealing said chamber (26), and said power source (96) is integral with said driver (98).

17. The apparatus as set forth in claim 15 further comprising said power source (96) being external to said housing (22) and said wires (100) further extending from said power source (96) and through said bore (144) and said washer (134) cable orifice and said spacer (126) cable orifice and said housing (22) orifice to said driver (98).

18. The apparatus as set forth in claim 15 further comprising a flow enhancer (114) having a tubular shape extending away from said downward platform (82) in said central cavity (88) about said chimney hole (106, 116, 118) to straighten the flow of air into said central cavity (88) of said chamber (26) from said bottom cavity (84) of said chamber (26).

* * * * *